US006895955B2

(12) United States Patent
Galassi

(10) Patent No.: US 6,895,955 B2
(45) Date of Patent: May 24, 2005

(54) BUILT-IN ASPIRATING HOOD

(75) Inventor: Alvaro Galassi, Fossato Di Vico (IT)

(73) Assignee: Faber S.p.A., Fabriano (IT)

( * ) Notice: Subject to any disclaimer, the term of this patent is extended or adjusted under 35 U.S.C. 154(b) by 0 days.

(21) Appl. No.: 10/403,391

(22) Filed: Mar. 31, 2003

(65) Prior Publication Data

US 2003/0188734 A1 Oct. 9, 2003

(30) Foreign Application Priority Data

Apr. 5, 2002 (IT) ..... MI20020187 U

(51) Int. Cl.[7] ..... F24B 13/00
(52) U.S. Cl. ..... 126/299 R; 126/299 D
(58) Field of Search ..... 126/299 R, 299 D; 454/49

(56) References Cited

U.S. PATENT DOCUMENTS 4,501,260 A * 2/1985 Grace ..... 126/299 R
4,934,337 A * 6/1990 Falk ..... 126/299 R
5,042,458 A * 8/1991 Spencer et al. ..... 126/299 R
5,062,410 A * 11/1991 Sarnosky et al. ..... 126/299 D

* cited by examiner

*Primary Examiner*—Alfred Basichas
(74) *Attorney, Agent, or Firm*—Hedman & Costigan, P.C.

(57) ABSTRACT

A built-in aspirating hood which can be applied in a suitable housing in a wall or in furniture, immediately behind a cooking surface and which consists of a parallelepiped body containing a suction fan and a seat for anti-fat filters, the parallelepiped body containing a suction fan and a seat for anti-fat filters. The parallelepiped body is equipped with two outlets, upper and rear, which can alternately be used to evacuate towards the outside the flow of fumes and vapours sucked by the inner fan.

10 Claims, 3 Drawing Sheets

BUILT-IN ASPIRATING HOOD

BACKGROUND OF THE INVENTION

The present invention refers to an aspirating hood to be built into a wall.

Currently, aspirating hoods for the kitchen are applied in a variety of ways.

A first way is a small distance above the cooking surface, for example about 65 cm. This is the most widespread installation, because it is the most traditional and the easiest to construct. It is effective, but rather awkward, because it is necessary to give particular attention to not banging one's head against the lower edge or the side rims of the aspirating hood and often it is necessary to twist one's body.

A second way is that on an island at the centre of the room. It is an installation which is similar to the one indicated previously and thus it keeps the advantages and defects thereof.

A third example is that of an aspirating hood integrated in the lower or base furniture. This installation, known and widespread in the USA, going by the name of "down draft" (shown in FIGS. 1*a*, 1*b*) foresees the presence of one or more grated suction zones, at the cooking surface level, to the right, left or behind, through which the fumes and vapours are sucked by a fan which is necessarily very powerful, and thus noisy, positioned inside the base. The suction power must be high because the flow of air must be deviated downwards, against its natural tendency to rise, with greater suction needed the hotter the airflow. To partially improve the efficiency of a system, normally one uses a telescopic boxed element (FIG. 1*c*), having an inlet opening for the air on its upper front part. This element, during use, extends electrically-driven from the surface of the base by about 20 cm, so as to reduce the deviation downwards of the flow of fumes and vapours.

This system, whilst offering practicality of use to the cooking surface which is free, is nevertheless very expensive, requires a very high evacuation capability and is thus noisy and disperses heat energy in winter, requires long and thick piping which is bent to return upwards towards the outside and occupies the lower part of the base furniture making it practically unusable.

BRIEF SUMMARY OF THE INVENTION

The general purpose of the present invention is therefore that of identifying an optimal solution to the aforementioned technical problems.

In particular, a purpose of the present invention is that of realising an aspirating hood which allows great freedom of movement and which has maximum ergonomics in use of the cooking zone. Indeed, we must try to eliminate all possible situations of risk of knocking the head of average and tall operators and situations of discomfort due to awkward movements when instinctively one goes to check how the cooking is coming along.

These purposes according to the present invention are accomplished by realising an aspirating hood to be built into a wall as outlined in the attached claim 1. Further salient characteristics and details of the present invention are object of the dependant claims.

An aspirating hood according to the invention is preferably applied into the thickness of the walls of a home, inside the kitchen space, or else, alternatively, also inside furniture. This aspirating hood must be positioned at the cooking surface, on the vertical masonry wall or inside the furniture arranged immediately behind the cooking surface itself, so as to be in the best conditions for sucking up the vapours and fumes coming from the cooking surface.

The characteristics and advantages of an aspirating hood according to the present invention shall become clearer from the following description, given as an example and not for limiting purposes, of an embodiment with reference to the attached figures, in which:

DETAILED DESCRIPTION OF THE INVENTION

Figure 1A:
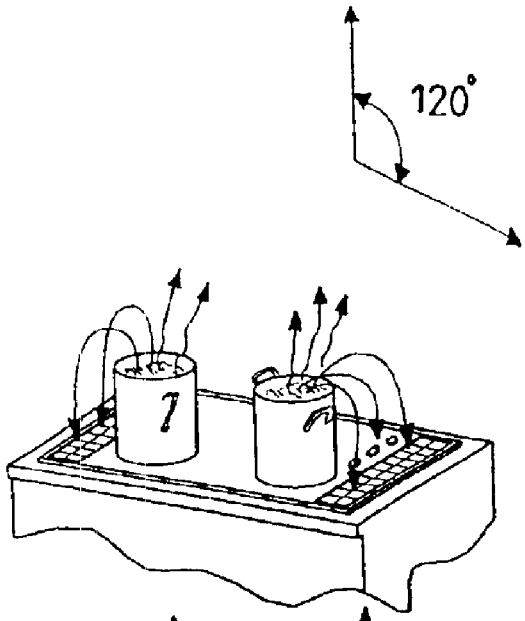
FIGS. 1*a*, 1*b* and 1*c* show perspective views of aspirating hoods according to the state of the art.
Figure 1B:
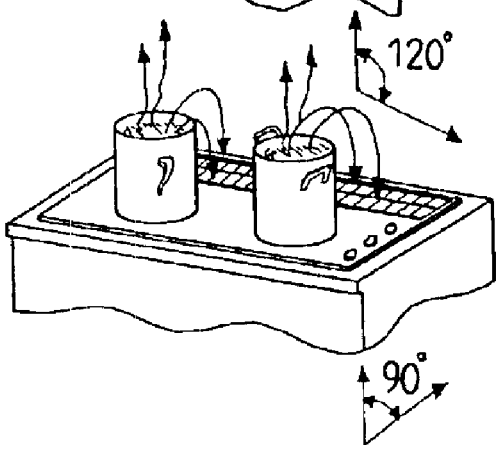
Figure 1C:
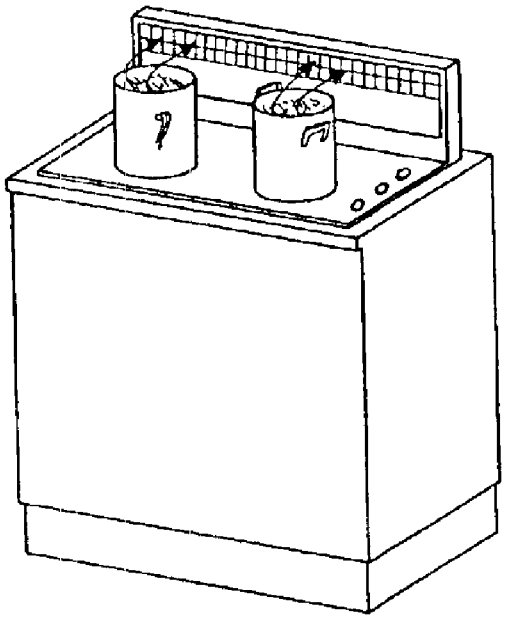
Figure 3:
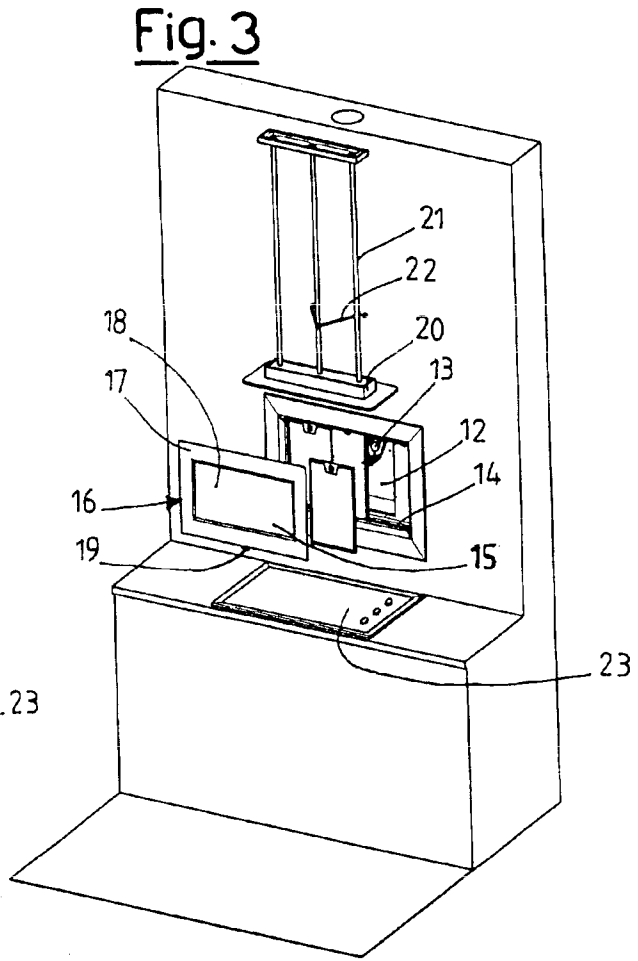
FIG. 3 shows a view similar to that of FIG. 2 where parts of the aspirating hood are removed.
Figure 2:
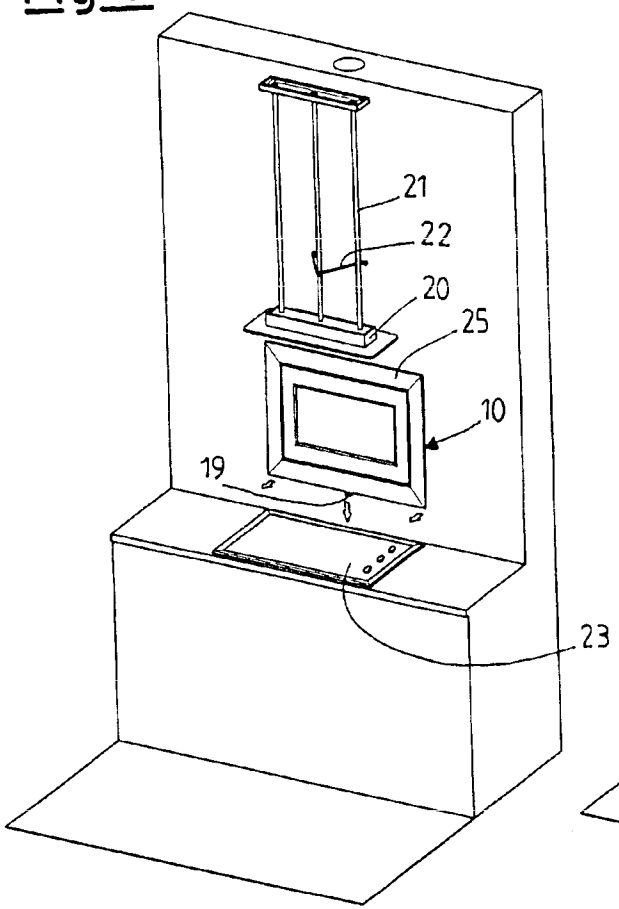
FIG. 2 shows a perspective view of an application of an aspirating hood according to the invention.

With reference generically to FIG. 1, an aspirating hood to be built into a wall according to the invention is shown in a totally schematic way, in which the aspirating hood is wholly indicated with 10.

The built-in aspirating hood 10, which is arranged at a cooking surface 23, consists of a substantially parallelepiped hollow body, preferably made from metal 12, inside of which a centrifugal fan 13 is fitted. This fan 13 can be fixed to the body 12 through screws or rapid attachment systems and it usually has the outlet facing upwards, but which can be rotated by 90° to allow an alternative rear outlet. Indeed, the parallelepiped body 12 is equipped with two outlets, one upper 24 and one lower 25, which can alternately be used to evacuate towards the outside the flow of fumes and vapours sucked in by the inner fan 13.

On the inner perimetric edge of the front face of the parallelepiped body an abutment 14 is formed for one or more anti-fat filters 15, preferably but not for limiting purposes made from multilayer perforated metal.

The outer perimetric edge of the front face is shaped so as to constitute a stop and positioning abutment, at the time when the parallelepiped body is inserted into the seat previously prepared in the wall or in the furniture.

On the parallelepiped body 12 a perimetric frame 26 is connected, which can be made from various materials like stainless steel, aluminium, glass or ceramic, the purpose of which is that of covering and refining the joining of the parallelepiped body with the wall or furniture.

The rectangular opening defined by the inner edge of the frame 26 is closed by a removable cover 16 also having a rectangular shape. This has sides shorter than the inner sides of the frame by about 3 cm, so as to intercept an annular passage for the air by about 1.5 cm all the way round. The cover 16 is in turn made up of a second frame 17 integral with a central flat rectangle 18 smaller in size than the inner part of the frame. The rectangle 18 is connected to the frame itself so as to intercept a second annular passage of air by about 1.5 cm, uniform all the way round.

These two rectangular annular passages of air force the passage of the flow sucked by the inner fan through very thin slits, so as to enormously increase the speed of the air at the slits themselves. This is due to the massive tightening of the passage section and thus with generation, by the Venturi effect, of annular areas of high depression which suck the surrounding air towards the annular passages, with the result of preventing the dispersion of the fumes and vapours sucked in outside of the work zone of the built-in aspirating hood.

It must be noted that by limiting the passage of air only at two tight annular slits there are large uninterrupted flat surfaces, which are pleasing to the eye and extremely easy to clean with a simple wipe with a cloth.

The central rectangle 18 can also be used for decorations or for utility services such as terminal and intelligent display of a multimedia system consisting of suitable components which can be inserted inside the parallelepiped body or, separately, at the most suitable distance.

The cover 16 is hooked attached at the top to the inner structure of the outer frame, with simple and secure attachment systems, such as to determine the detachment and removability of the cover after a rotation of the cover itself by about 45° about the upper hinging points and after having previously pulled a lower ball grip 19, which locks the cover with an inner lockbolt, downwards.

A lighting group 20, in the embodiment of the present invention, is separate for the purpose of having the widest and least restrictive sizing of the parallelepiped body 12, using very powerful (and therefore large) bulbs which produce a high intensity of lighting of the cooking surface whilst still being installed at a height such as not to be an obstacle or risk to the head of the operator. The application foresees the attachment of the lighting group 20 to the ceiling of the kitchen through connection pipes 21 in which the cables pass, in a vertical position centred with respect to the cooking surface, with a triangular anchoring 22 towards the wall into which the aspirating hood is built for the purpose of eliminating any movement or oscillation of the group itself.

Alternatively, the lighting group can be installed directly on the wall immediately above the outer frame of the aspirating hood, through a different configuration and length of the connection pipes.

A further possibility is to integrate the lighting system in the same upper frame of the aspirating hood, through a boxed element containing the bulbs, rotating about its upper rim, so as to be able to be removed as required, manually or automatically. In this case the bulbs shall be less powerful due to the space available.

It can therefore be seen how the present invention solves all of the problems quoted above.

Figure 4A:
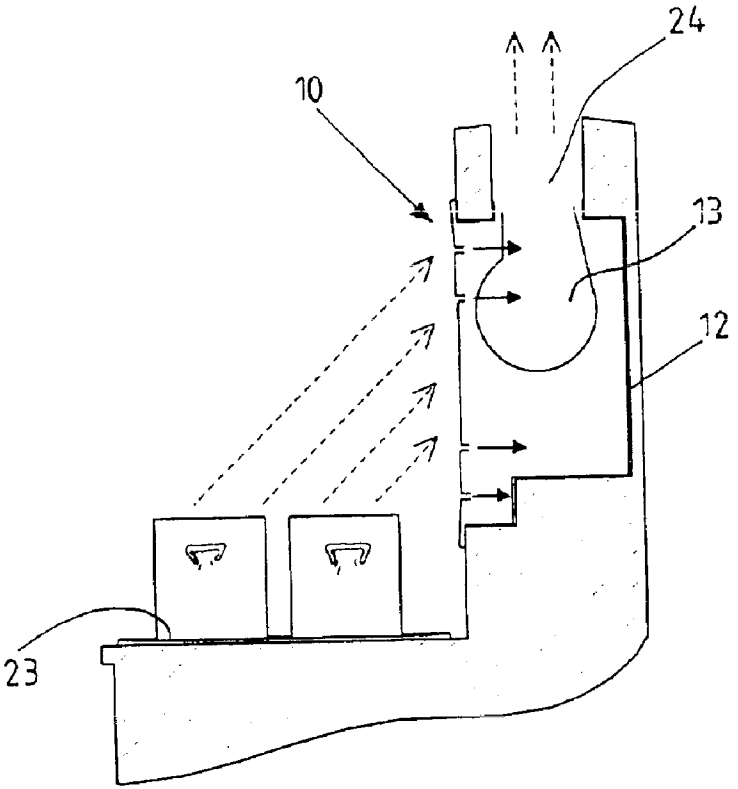
FIGS. 4*a* and 4*b* shows how the flow of fumes and vapours must be deviated in an aspirating hood according to the invention.
Figure 4B:
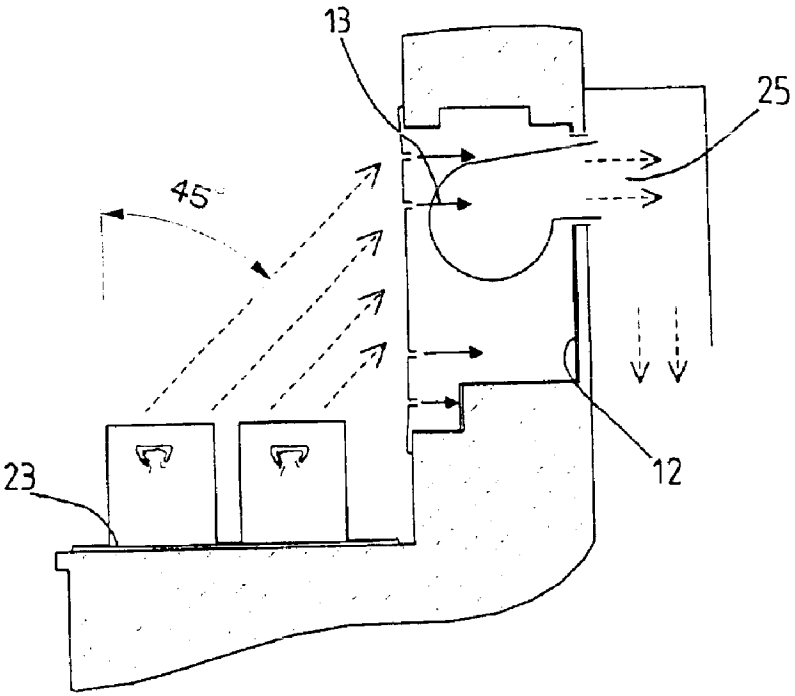

The invention is efficient, given that is does not have moving parts: indeed, the flow of fumes and vapours must be deviated only by about 45°, as shown in FIGS. 4*a* and 4*b* with respect to vertical instead of about 90° (FIG. 1*c*) or 120° (FIG. 1*a*, 1*b*) as is necessary in the case of the boxed, telescopic, removable element or in the worse case of grated openings on the top of the base of the furniture. The piping is either directed upwards (outlet through the roof) or backwards (outlet directed towards the outside through then wall). Therefore, there are not significant pressure drops due to curves and throttles.

The aspirating hood is cost-effective, because there are not electrically-driven removable parts.

Moreover, it is quiet, because it is built into the wall and because a very high flow rate is not required. It should not be forgotten that it is practical and ergonomic, because it leaves the operator completely free in his movements, even instinctive ones, and it allows the food to be checked upon easily. The space inside the furniture is completely available.

Finally, the aspirating hood of the invention fits in with the furniture and adds value because it allows the use of alternative quality materials like stainless steel, anodised aluminium, glass or ceramic, in harmony with the rest of the kitchen furniture.

We therefore repeat that the advantages of the present invention are:

- great freedom of movement and maximum ergonomics in use of the cooking area, with the elimination of any risk, especially for the head of the operator, a risk which is normally present in conventional applications of aspirating hoods for the kitchen placed above, and not behind, the cooking surface, at a vertical distance from the surface itself which varies from the ground from 1.55 to 1.75 m, generating situations of risk of operators of medium and tall height banging their head and awkwardness due to movements which are not very comfortable when instinctively one goes to check how the cooking is coming along;
- possibility of using the upper space on the wall, above the built-in aspirating hood, to apply racks for spices, oil, condiments and cooking utensils;
- great efficiency of cooking of the vapours and fumes which are sucked towards the wall behind the cooking surface, through the inclination of the flow of air determined by the fan inside the aspirating hood in the area above the cooking surface;
- great effectiveness of lighting, which is preferably separate and thus can be made large and powerful without the usual restrictions set by the size of the apparatus. Alternatively, the lighting can also be integrated in the aspirating hood, removing it from its seat at the time of use;
- excellent added value in terms of design and for the extremely clean look, both due to the decorative effect which makes the aspirating hood look like a picture, and the personal touches and aesthetic differences permitted by different materials like stainless steel, ceramic, glass and aluminium, with which the outer part, on the front of the apparatus, slightly protruding or flush with the wall, can easily be realised.

Moreover, in practice the materials used, as well as the sizes and the components, can be whatever according to the technical requirements.

What is claim is:

1. A built-in aspirating hood, adapted for insertion in a vertical wall or in a vertical opening in furniture, immediately adjacent to a cooking surface, said hood comprising a substantially parallelepiped body having a front face opening on a front vertical surface of said aspirating hood, an inner suction fan capable of rotating 90°, a seat for removable anti-fat filters mounted in said front face opening, said substantially parallelepiped body having two outlets, an upper outlet and a rear outlet, which can alternately be used to evacuate towards the outside a flow of fumes and vapors sucked by said inner suction fan through said front face opening, so that said fumes and vapors exit vertically or horizontally depending on the rotation of said inner suction fan.

2. A built-in aspirating hood according to claim 1, further comprising a frame, that is joined to and covers said parallelepiped body to said wall or said opening, said frame comprising an inner area defined by a first frame aligned with said front face opening of said parallelepiped body, inside said inner area of said first frame a removable central cover of a shorter perimetric size creates a first annular passage for said fumes and vapors to be sucked through.

3. A built-in aspirating hood according to claim 2, wherein said removable central cover further comprises a second frame integrally connected to a flat central element smaller in size with respect to that of an inner area defined by said second frame, that defines a second annular passage area for said fumes and vapor.

4. A built-in aspirating hood according to claim 3, wherein said first and second annular passage areas are less than the total passage area of said anti-fat filters, said first and second annular passage areas being sized to create Venturi effect by increasing the speed of said fumes and vapor as they pass through said first and second annular passages pulling said fumes and vapors from said cooking surface.

5. A built-in aspirating hood according to claim 3, wherein said removable central cover is attached at a top surface of said central cover to said first frame by suitable attachments integral with said first frame, being able to rotate on said attachments by about 45° until a catch between said top of said removable central cover and said attachments is freed making said cover detachable for access to said anti-fat filters and said inner suction fan for cleaning and maintenance operations.

6. A built-in aspirating hood according to claim 5, wherein said removable central cover is held in said first frame by a vertically sliding lockbolt, said vertically sliding lockbolt adapted to be opened by pulling down on a central ball grip which protrudes in a lower wall of said first frame.

7. A built-in aspirating hood according to claim 2, wherein said removable central cover is from a material selected from the group consisting essentially of stainless steel, aluminum, glass and ceramic.

8. A built-in aspirating hood according to claim 2, wherein said removable central cover further comprises a terminal display for multimedia systems.

9. A built-in aspirating hood according to claim 1, further comprising a lighting group for lighting said cooking surface.

10. A built-in aspirating hood according to claim 2, wherein said first frame is rectangular in shape.

* * * * *